United States Patent [19]

Beshro

[11] Patent Number: 4,996,721

[45] Date of Patent: Mar. 5, 1991

[54] COMBINED SEAT CUSHION AND BASEBALL MITTEN

[76] Inventor: Edward Beshro, 7493 St Hubert, Montreal, Quebec, Canada, H1R 2N5

[21] Appl. No.: 367,742

[22] Filed: Jun. 19, 1989

[30] Foreign Application Priority Data

Jun. 20, 1988 [GB] United Kingdom ..... 8814578

[51] Int. Cl.[5] ..... A41D 13/10; A47C 27/00; A47C 31/00

[52] U.S. Cl. ..... 2/19; 5/448; 297/219

[58] Field of Search ..... 2/19; 5/448; 297/219

[56] References Cited

U.S. PATENT DOCUMENTS

| | | | |
|---|---|---|---|
| 1,767,115 | 6/1930 | Berry | 2/19 |
| 2,281,315 | 4/1942 | Latina | 2/19 |
| 2,452,695 | 11/1948 | Sonnett et al. | 2/19 |
| 2,528,802 | 11/1950 | Turner | 2/19 |
| 2,681,448 | 6/1954 | Tompkins | 2/19 |
| 3,141,173 | 7/1964 | Jackson et al. | 2/19 |
| 4,365,352 | 12/1982 | Zidele | 2/19 |
| 4,665,561 | 5/1987 | Aoki | 2/19 |

*Primary Examiner*—Paul T. Sewell
*Assistant Examiner*—Ted Kavanaugh
*Attorney, Agent, or Firm*—Foley & Lardner, Schwartz, Jeffery, Schwaab, Mack, Blumenthal & Evans

[57] ABSTRACT

Disclosed is a combined seat cushion and baseball mitten comprising a flat padded body defining a seat section and a pair of spaced thigh sections integrally extending from the seat section. The body is divided into two substantially symmetrical portions by a foldline across the seat section with the thigh sections located on either side of the foldline so that the two portions can be folded one over the other. The two thigh sections are connected together by a web and a basket-like catching pocket is provided on one face of the body above the web, the pocket having an opening facing the web. There is also provided, on the other face of the body, a pair of hand-holding straps, each strap being located on one side over the foldline and therein being secured to the thigh sections so as to serve for holding the thumb and the other fingers of a user's hand, respectively.

10 Claims, 3 Drawing Sheets

COMBINED SEAT CUSHION AND BASEBALL MITTEN

BACKGROUND OF THE INVENTION

1. Field of the Invention

The present invention relates to a baseball mitten particularly configured so that it may also be used as a seat cushion. In this sense, the article of the invention may be called a seat cushion and baseball mitten combination.

2. Description of the Prior Art

It is well known that, during a baseball game, balls are often thrown into the banked seats of the stadium where spectators attempt to catch them to be kept as souvenirs. In fact, some spectators do bring with them, for that purpose, conventional gloves or mittens.

On the other hand, it is known also that the seats of a stadium are quite rugged structures made of tough material so that they may withstand abuse. Nor are they cushioned for the same reason and also to avoid vandalism. Now, baseball games can often last a few hours so that the seats become quite unconfortable and many spectators bring seat cushions with them that they place on the seats.

SUMMARY OF THE INVENTION

It is accordingly an object of the invention to propose an article of manufacture that may be used selectively as a cushion and as a mitten for catching lost baseball thrown into baseball stands.

Another object is to provide such an article that can be manufactured easily and at low cost while still durable for its intended use.

In accordance with the invention, both of these objects are achieved with a combined seat cushion and baseball mitten which essentially comprises a flat padded body shaped to define a seat section and a pair of spaced thigh sections integrally extending from the seat section. The body is divided into two portions by a foldline across the seat section with the thigh sections located on either side of the foldline so that the two portions can be folded one over the other. The two thigh sections are connected together by a web and a basket-like catching pocket is provided on one face of the body above the web; the pocket having an opening facing the web. There is also provided, on the other face of the body, a pair of hand-holding straps; each strap being located on one side over the foldline and therein being secured to the thigh sections so as to serve for holding the thumb and the other fingers of a user's hand, respectively.

BRIEF DESCRIPTION OF THE DRAWINGS

A preferred embodiment of the invention will now be described, having reference to the drawings in which:

FIGS. 5 and 6 being also intended to illustrate how the mitten is held by user's hand.

DESCRIPTION OF THE PREFERRED EMBODIMENT

Figure 6:
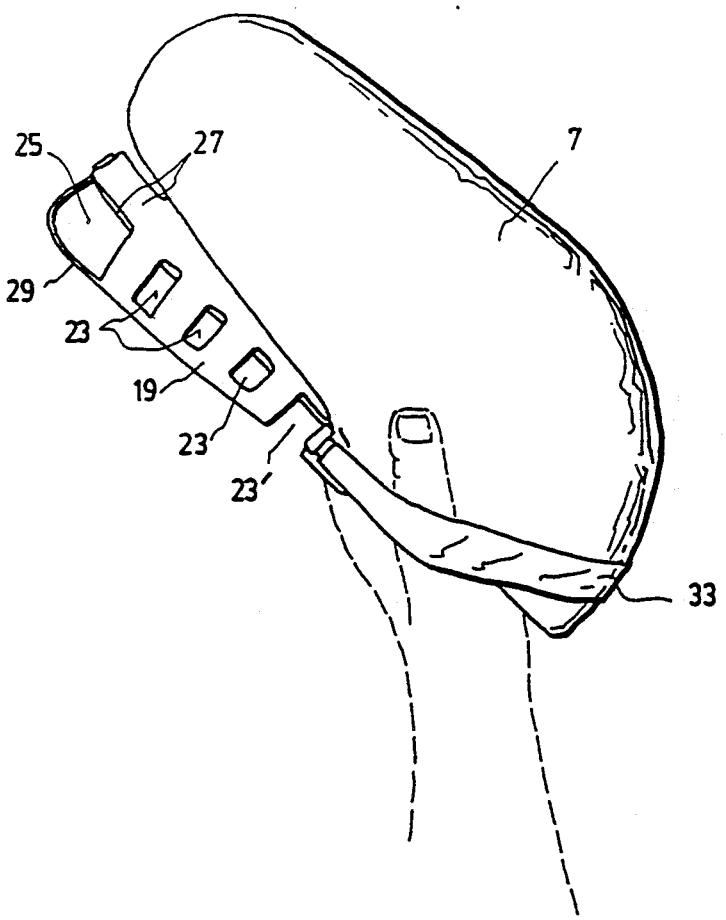
FIG. 6 is a perspective view of the mitten seen at another angle and in completely folded condition.
Figure 3:
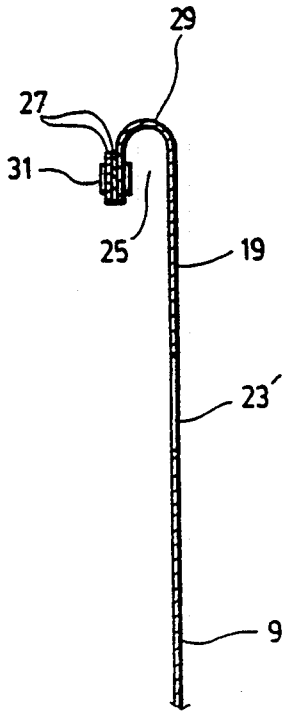
FIG. 3 is a cross-sectional view taken along line III—III in FIG. 2.

As shown in FIGS. 1 to 4, the cushion-mitten combination includes a flat padded body 3 having a seat section 5 and a pair of spaced thigh section 7 that extend from and are integral with the section 5. The body 3 is divided into two portions by a foldline 9 extending across the seat section 5 so that the portions may be folded completely one over the other, as shown in FIG. 6.

The body 3 is made up of two U-shaped flexible plastic sheets, such as vinyl sheets, heat sealed along the seams 11 and along the foldline 9 to provide two pouches into which pads of foam plastic material are inserted.

The thigh sections 7 define between them and with the seat section 5 an essentially U-shaped slot 13 having a bight 15 and two outwardly diverging legs 17. This slot is covered with a web 19 of flexible plastic material, such as vinyl, of which the edges are heat related to the adjacent seams 11 of the thigh sections 7 and seat section 5 along the bight 15 and the legs 17. The body 3 and web 19 are shown to be symmetrical with respect to a center line 21, along which extends the foldline 9. The web 19 may be latticed by apertures 23 located on either side of the center line 21 to give it added flexibility; the lower aperture 23' extending across the line 21.

Figure 1:
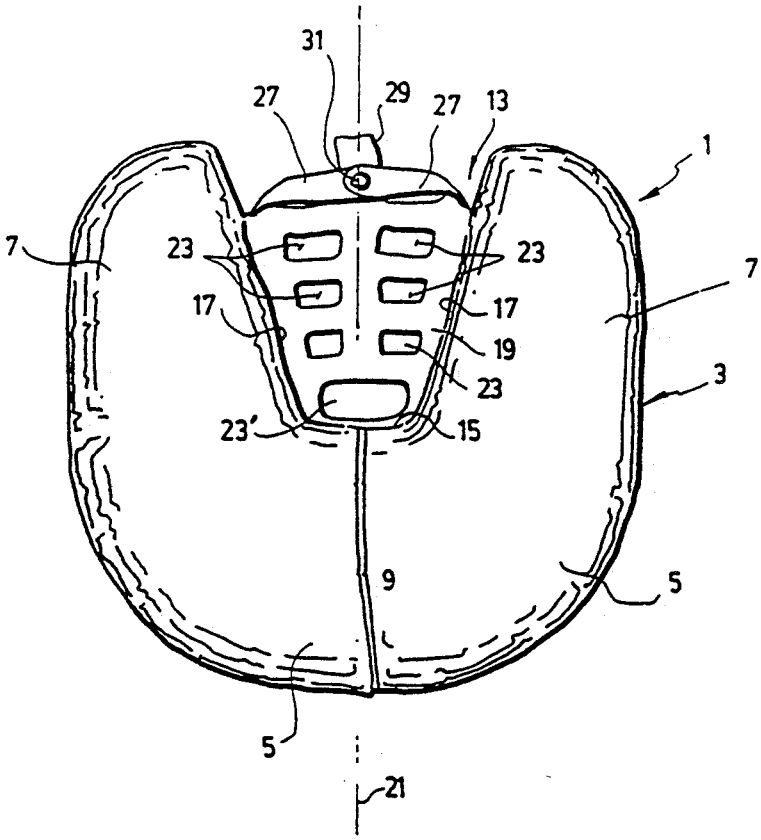
FIG. 1 is a front view of a baseball mitten, made according to the invention, shown in flat unfolded condition.
Figure 4:
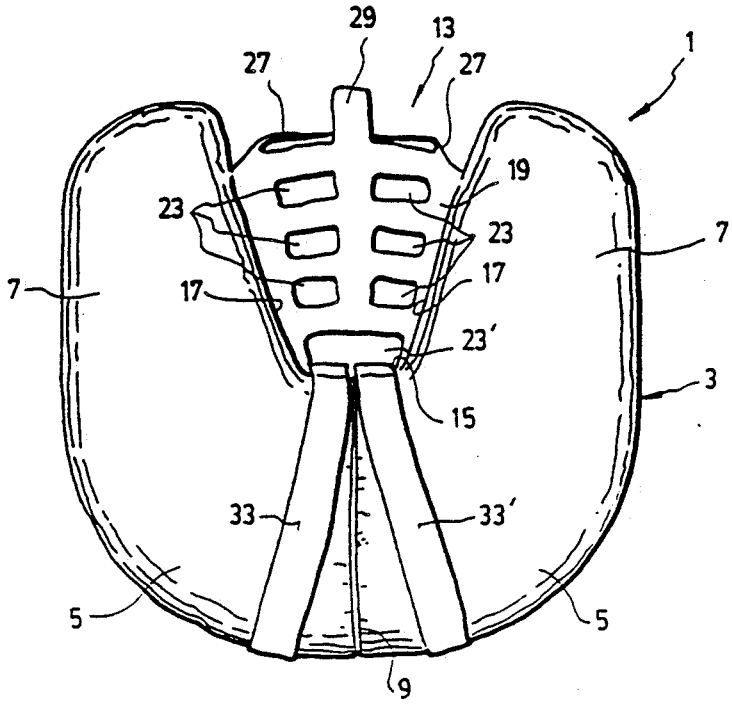
FIG. 4 is a back view of the article of FIG. 1, also shown in unfolded condition.

Means are provided at the top edge of the web 19 that define a pocket 25 (FIG. 3) located on the front face of the body 3 and intended to catch baseballs 35 (FIG. 5) and having a pocket opening facing the web 19. In this embodiment, the pocket 25 is formed by a pair of flexible side straps 27, made of plastic material such vinyl, and extending laterally away from the thigh sections 7 and having one end heat sealed to the sections 7 along the legs 17 of the slot 13. The pocket 25 is also formed by a third central strap 29 of vinyl, of which one end is integral with the top of the web 19, as seen in FIG. 4, the central strap 29 bends bask over the web 19 and all three straps are secured together, at their free ends, by a rivet 31.

Figure 5:
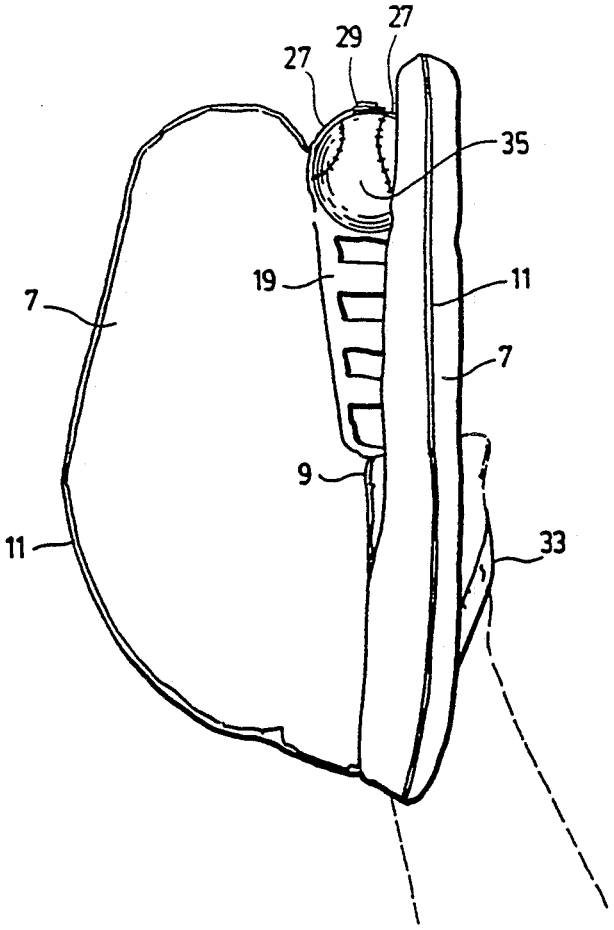
FIG. 5 is a perspective view of the mitten of FIGS. 1 to 4 in folded and baseball-holding condition.
Figure 2:
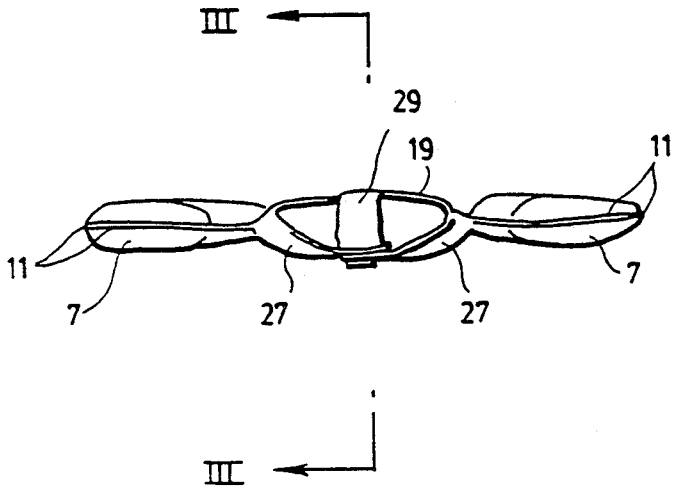
FIG. 2 is a top plan view of the same.

Finally, a pair of flexible hand-holding straps 33, 33' vinyl, is provided on the back face of the body 3 (FIG. 4) over the seat section 5; straps 33, 33', being located on either side of the foldline 9, having their ends heat sealed to the body 3, at the bight 15 and at the other periphery of the seat section. The straps formed a inverted V. As will be gathered from FIGS. 5 and 6, these straps 33, 33', serve for holding the thumb and other fingers of a user's hand, respectively. FIG. 5 shows a baseball 35 lodged into the pocket 25. As also to be gathered from FIGS. 1, 3 and 6, folding of the thigh sections 7 toward one another from their coplanar position of FIGS. 1 and 4, causes the opening of the pocket 25 to be widened and thus ease the invention of the baseball 35.

I claim:

1. A seat cushion and baseball mitten combination comprising:

a flat padded body having a pair of faces, said body being shaped to define a seat section and a pair of spaced thigh sections extending from and integral with said seat section;

means defining a foldline across said seat section with said thigh sections located on either side thereof, said foldline dividing said body into two substantially symmetrical portions foldable one over the other from a coplanar position thereof;

said body being movable from a flat seat cushion forming position to a baseball mitten position folded along said foldline;

said seat section and said thigh sections being substantially coplanar in the seat cushion forming position, wherein said faces are substantially parallel to each other and to a seat on which the seat cushion is placed;

a web of flexible sheet material joining said thigh sections;

means defining a pocket, for catching baseballs, on one of said faces of said body at the end of said web away from said foldline and between said thigh sections, said pocket having an opening facing said web, and a pair of flexible hand-holding straps provided on the other of said faces of said body over said seat section; each strap being located on one side of said foldline and the ends of said straps being secured to said seat section whereby to serve for holding the thumb and the other fingers of a user's hand, respectively.

2. A combination as claimed in claim 1, wherein said pocket-defining means comprise:

a pair of flexible side straps, each side strap extending laterally away from one of said thigh sections in the direction of the other thigh section;

a central strap extending from the center of said web and bending over said web, and means securing the free ends of said straps to form said pocket.

3. A combination as claimed in claim 2, wherein said padded body, web and pocket are symmetrical with respect to said foldline.

4. A combination as claimed in claim 3, wherein said web is latticed by apertures located on either side of said foldline.

5. A combination as claimed in claim 1, wherein said thigh sections define, between them and with said seat section, a U-shaped slot in which said web is located.

6. A combination as claimed in claim 5, wherein said slot forms a bight and said hand-holding straps are secured to said body at said bight and at the outer periphery of said seat section.

7. A combination as claimed in claim 6, wherein said pocket-defining means comprise:

a pair of flexible side straps each of said side straps extending laterally away from one of said thigh sections in the direction of the other thigh section;

a central strap extending from the center of said web and bending back over said web, and means securing the free ends of said straps to form said pocket.

8. A combination as claimed in claim 7, wherein said padded body, web and pocket and symmetrical with respect to said foldline.

9. A combination as claimed in claim 8, wherein said web is latticed by apertures located on either side of said foldline.

10. A combination as claimed in claim 9, wherein said body comprises a plastic cover filled with foam plastic material and said web and straps are made of plastic material.

* * * * *